United States Patent [19]

Wysocki

[11] 4,158,412

[45] Jun. 19, 1979

[54] TEAR OUT OPENING DEVICE

[75] Inventor: Lawrence Wysocki, Chicago, Ill.

[73] Assignee: Champion International Corporation, Stamford, Conn.

[21] Appl. No.: 919,227

[22] Filed: Jun. 26, 1978

[51] Int. Cl.[2] ..... B65D 5/54

[52] U.S. Cl. ..... 206/612; 206/628

[58] Field of Search ..... 206/620, 628, 605, 608, 206/612

[56] References Cited

U.S. PATENT DOCUMENTS

| | | | |
|---|---|---|---|
| 2,589,168 | 3/1952 | Vassar | 206/620 |
| 2,828,060 | 3/1958 | Brown | 206/628 |
| 3,019,944 | 2/1962 | Nelson et al. | 206/628 |
| 3,207,411 | 9/1965 | Farquhar | 206/628 |
| 3,580,466 | 5/1971 | Thelen et al. | 206/628 |
| 3,620,438 | 11/1971 | Wood | 206/620 |
| 3,982,685 | 9/1976 | Shimada | 206/628 |

FOREIGN PATENT DOCUMENTS

| | | | |
|---|---|---|---|
| 1042456 | 10/1958 | Fed. Rep. of Germany | 206/620 |

*Primary Examiner*—Stephen P. Garbe
*Attorney, Agent, or Firm*—Evelyn M. Sommer

[57] ABSTRACT

A tear out opening member or flap for use with paperboard cartons and the like comprises a paperboard substrate having an upper surface and an opposed lower or undersurface. The substrate includes a first cut portion disposed on the upper substrate surface and penetrating the upper surface to a point intermediate the thickness of the substrate. A second cut portion is disposed on the undersurface of the substrate, the second cut being spaced apart from the first cut and enveloping the first cut. Alternatively the disposition of first and second cuts may be reversed such that the first cut envelopes the second cut. The second cut penetrates the undersurface to a point intermediate the thickness of the substrate. Spaced apart reinforcement hinge members are disposed along the second cut at a predetermined angle thereto.

9 Claims, 9 Drawing Figures

TEAR OUT OPENING DEVICE

BACKGROUND OF THE INVENTION

The subject invention relates to paperboard cartons, and specifically, to paperboard cartons having tear out opening members. Typically, cartons, such as for example, tissue boxes, include a panel member which may be torn from the box in order to obtain access to the contents thereof. In typical cartons the access panel is outlined by perforations that maintain the panel intact in the carton until the contents are removed as needed. However, cartons of this type are generally made of material composed of laminated plys or layers that tend to separate or delaminate and present a ragged and unsightly appearance when the panel is removed. When the contents of the carton are tissues, the tissues have a tendency to become snarled along the ragged edges of the perforations.

Accordingly, it is an object of the subject invention to provide a carton having a tear out opening member or flap which is designed so as to permit the access member to be torn without there being left behind unsightly delaminations or ragged edges which tend to interfere with the removal of tissues. Further objects and advantages of the subject invention will become apparent from a consideration of the following detailed description taken in connection with the accompanying drawings.

SUMMARY OF THE INVENTION

In accordance with the subject invention, a tear out opening member for use with paperboard cartons includes a paperboard substrate having an upper surface and an opposed lower or undersurface. A first inner peripheral cut portion, typically oval in configuration, is disposed on the upper substrate surface and penetrates said surface to a point intermediate the thickness of the substrate. An outer peripheral cut portion, also typically oval in configuration, is disposed on the undersurface of the substrate, the outer peripheral cut being spaced apart from the inner cut, and enveloping the inner cut. The outer peripheral cut penetrates the undersurface to a point intermediate the thickness of the substrate. The separation between the inner and outer cuts may be in the range of approximately ⅛ to 1/32 inches. Typical separations are 1/32 inches, 1/16 inches and ⅛ inches. In the preferred embodiment of the subject invention, a plurality of spaced apart hinge members are included along the periphery of the outer cut, the hinge members being disposed at a suitable angle to the cut portion. Typically, the hinge members may be at an angle 45° or 90°. The hinge members serve to reinforce the separations between the cuts. For added reinforcement, spaced apart hinge members may also be included along the periphery of the inner cut on the upper substrate surface.

In an alternate embodiment, the generally oval cut portion in the lower or under surface is effectively enveloped by the generally oval cut portion in the upper surface. In such case, the paperboard substrate may be a solid bleached sheet whereby the generally oval line of separation will appear white after the tear out opening member is removed.

DETAILED DESCRIPTION OF THE PREFERRED EMBODIMENTS

Figure 1:
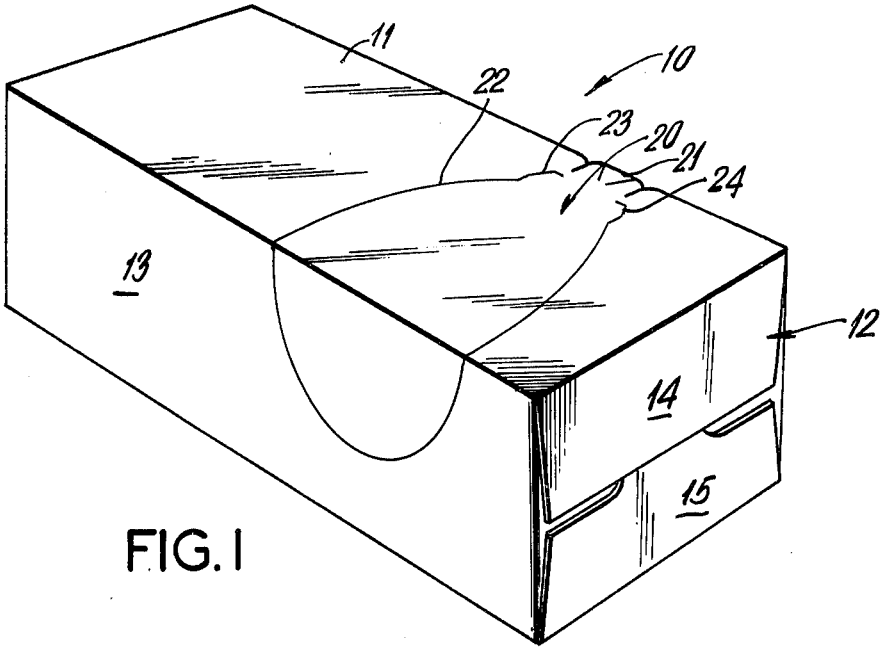
FIG. 1 is a perspective view of a preferred embodiment of a carton employing the tear open member of the subject invention.

Referring to FIG. 1, a typical carton employing the subject invention is designated generally by reference numeral 10 and comprises a tubular paperboard container for facial tissues and the like. As illustrated, container 10 includes a top panel 11, an end panel 12 having closure flaps 14 and 15, and a sidewall 13. Although not shown, it will be appreciated that the subject carton 10 also includes another sidewall, end wall and bottom panel.

Further referring to FIG. 1, the tear out member of the subject invention is designated generally by reference numeral 20. As illustrated, panel 20 has a generally oval periphery 22 which traverses panels 11 and 13. It will be appreciated, however, that tear out member 20 can have any configuration, and in addition, it may be solely contained on one panel, such as for example, panel 11. Panel 20 includes a tab member 21 which may be grasped for facilitating the removal of panel 20 from the container.

Figure 2:
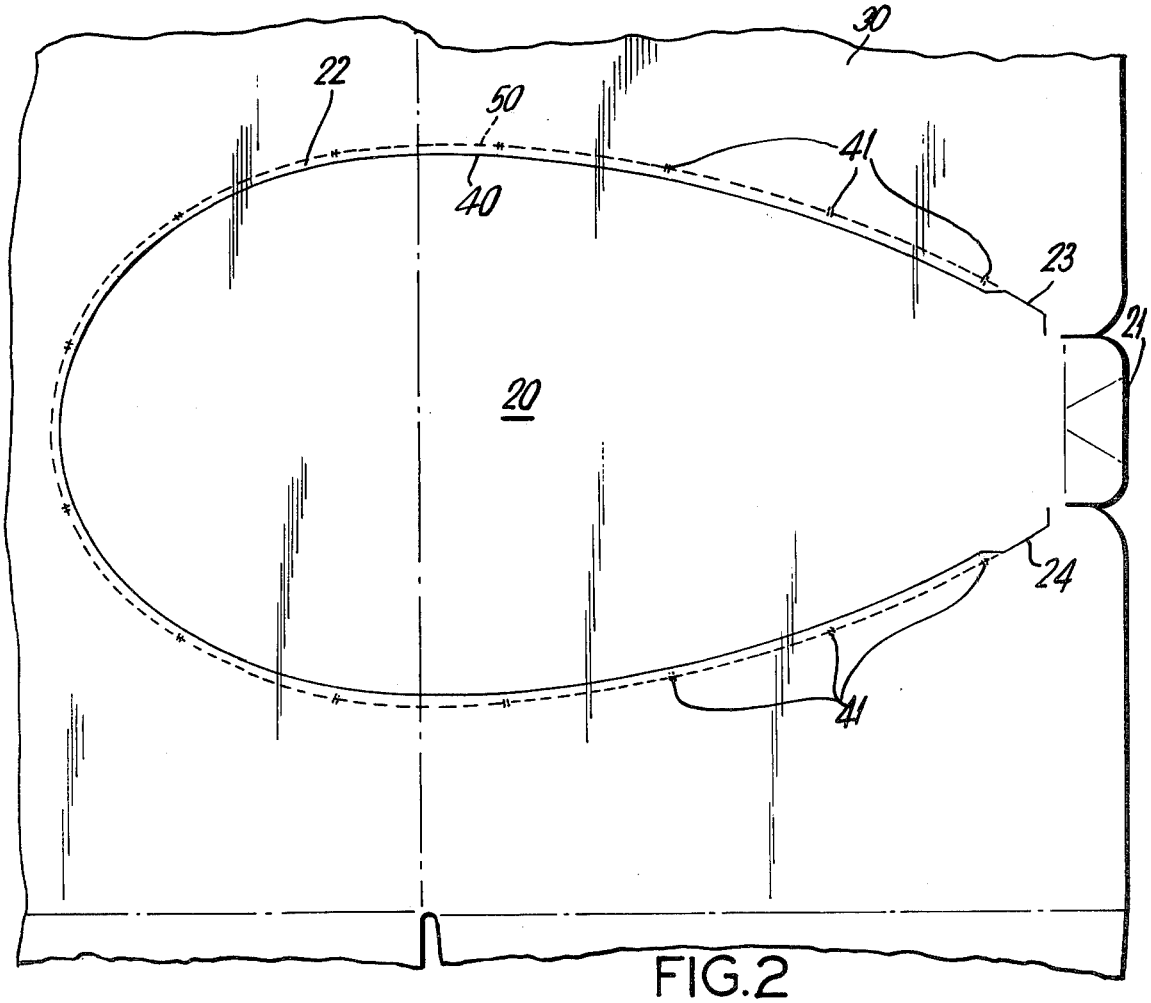
FIG. 2 is a plan view of the tear open member of FIG. 1 of the subject invention.
Figure 4:
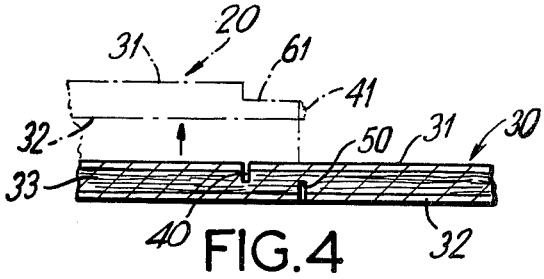
FIG. 4 is a partial cross sectional view of the tear open member of the subject invention along line 4—4 of FIG. 3.

Turning now to FIGS. 2 and 4 the carton 10, and specifically the tear out member 20 of the subject invention, is formed on a paperboard substrate 30 having an upper surface 31, an undersurface 32, and a core 33 comprising several plies of very thin newsback board. Generally upper surface 31 is the printed portion of the carton. In addition, it is preferably that upper surface 31 have a protective coating, such as for example, a polyethylene coating. Undersurface 32 is generally merely the uncoated paperboard stock. Referring specifically to FIG. 2, it will be noted that the substantially oval periphery 22 of member 20 is actually defined by a pair of spaced apart portions 40 and 50 which are cut into the surfaces of substrate 30. More particularly, periphery 22 is defined by a first cut portion 40 which is disposed on upper substrate surface 31 and penetrates the substrate to a point intermediate the thickness thereof. Preferably, cut 40 penetrates to one-half the thickness of the substrate 30. The periphery 22 of the subject tear out member further includes a second cut portion 50 disposed on the lower or under surface 32 of substrate 30; cut portion 50 being laterally spaced apart from cut portion 40 and substantially enveloping cut portion 40.

Preferably, cut 50 is generally parallel to cut portion 40 and penetrates substrate 30 one-half the thickness thereof. The spacing between cuts 40 and 50 may typically be 1/32 inches, 1/16 inches, or ⅛ inches. The cuts 40 and 50 may be produced in the substrate 30 by parallel cutting rules disposed above and below the surface of the substrate. In addition, instead of the conventional steel rule wood block combination, the cuts can be made from laser-cut plates.

Figure 3:
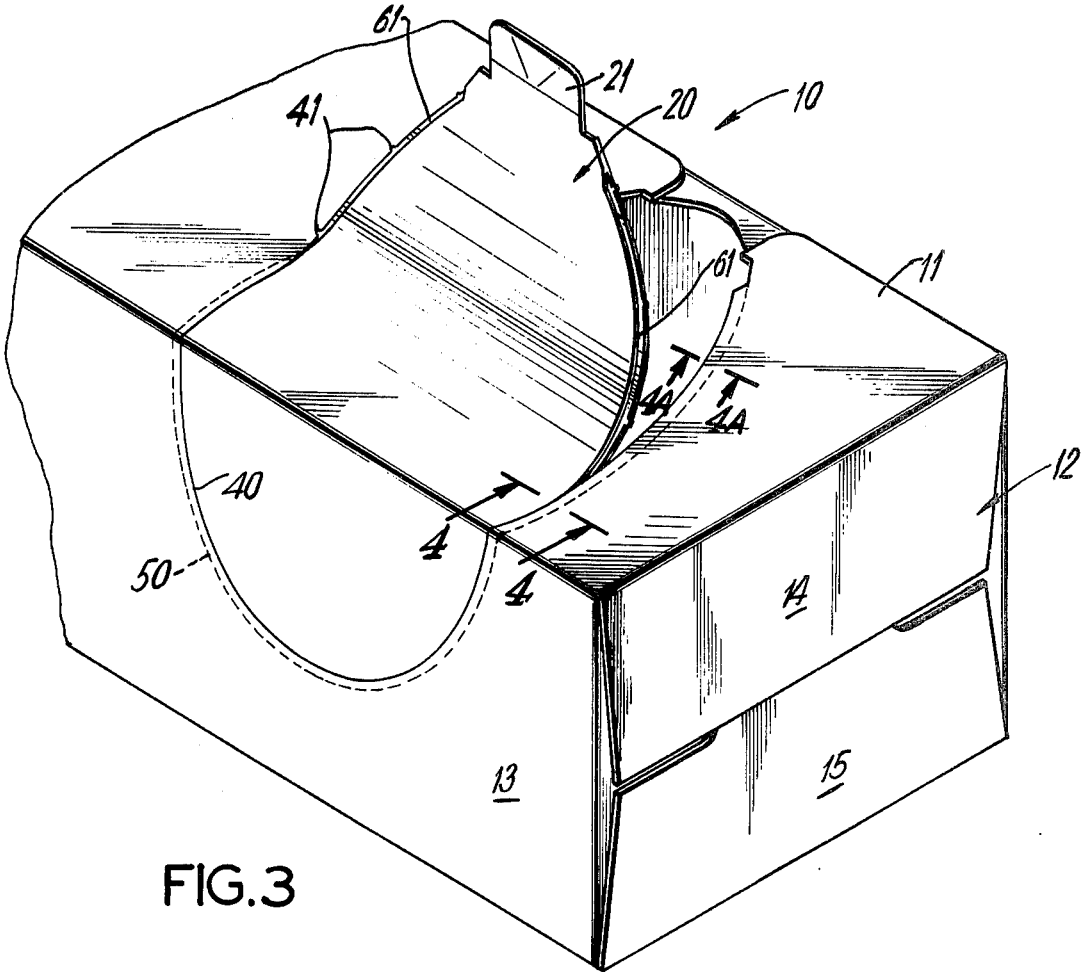
FIG. 3 is a partial perspective view of the carton of FIG. 1 of the subject invention in which the tear open member is partially torn.

Further referring to FIGS. 2, 3, and 4, in the preferred embodiment of the subject invention, the tear out member 20 includes a plurality of spaced apart reinforcement hinge members 41 which extend along the undercut 50, and are preferably disposed at an angle of 90° to the cut. Because hinge members 41 are disposed in substrate undersurface 32 they are not visible on the upper or printed surface 31 of the carton. It should be noted however, that where extra strength is needed, such as when the spacing between cuts 40 and 50 is on the order of 1/32 inches, additional hinge members disposed on upper surface 31 along and within cut 40 may be added.

Figure 5:
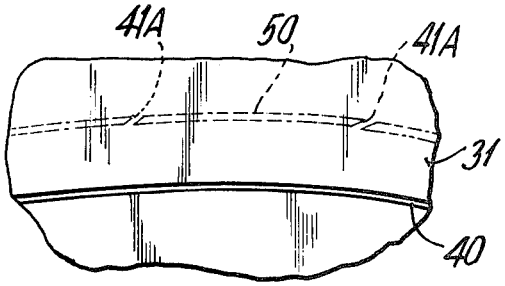
FIG. 5 is a partial plan view of a second embodiment of the tear out member of the subject invention.

In the alternate embodiment illustrated in FIG. 5, the reinforcement hinges 41A are disposed at an angle of 45° to lower cut 50. Preferably, hinge members 41 and 41A have the thickness of the paperboard substrate 30. It will be noted that the reinforcement hinges 41 and 41A may be provided by placing appropriately configured nicks or grooves in the underside cutting rule. Thus, where the nicks exist in the cutting rule, the substrate will not be cut, and the hinge members 41 and 41A formed.

Figure 4A:
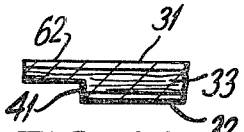
FIG. 4A is a partial cross sectional view of the tear open member of the subject invention taken along line 4A—4A of FIG. 3.

Turning now to FIGS. 3, 4, and 4A the tear out member 20 may be removed from the carton 10 by grasping and pulling tab member 21. It will be noted that access member 20 includes a pair of initial cuts 23 and 24 (see FIG. 2) which penetrate the entire thickness of substrate 30 for facilitating removal of member 20. As tab 21 is pulled upwardly, tensile and shearing forces are exerted between upper cut 40 and lower cut 50. Accordingly, access member 20 tears along upper cut 40 and shears the substrate 30 intermediate its thickness in the substrate core area 33 between cut 40 and cut 50. As a result, access member 20 is torn from the carton in a manner illustrated in the phantom portion of FIG. 4, and the surface of the carton remaining, as illustrated in FIG. 4A, comprises a complimentary configuration. More particularly, torn member 20 is left with an under shear portion 61, and the remaining carton is left with an upper shear portion 62 which is of complimentary configuration to shear portion 61. It will be noted that because of the particular configuration of cuts 40 and 50, shear portion 62 remaining on the carton after member 20 has been torn is coated and thus, there is no unsightly uncoated newsback board stock of the core 33 showing on the remaining carton. The shear portion 61 which includes a portion of exposed newsback board core 33 is removed along with tab member 20. In addition, it will be noted that the outline of the access aperture remaining in the carton after member 20 has been removed is smooth, thus preventing any unwanted snarling of the tissues as they are removed from the carton.

It will be further noted that upon tearing of access member 20 there is a break along each hinge member 41. However because of the relationship of cuts 40 and 50 the stubble of hinge member 41 left behind on the carton is hidden from view by coated shear portion 61. (See FIG. 4A).

Figure 6:
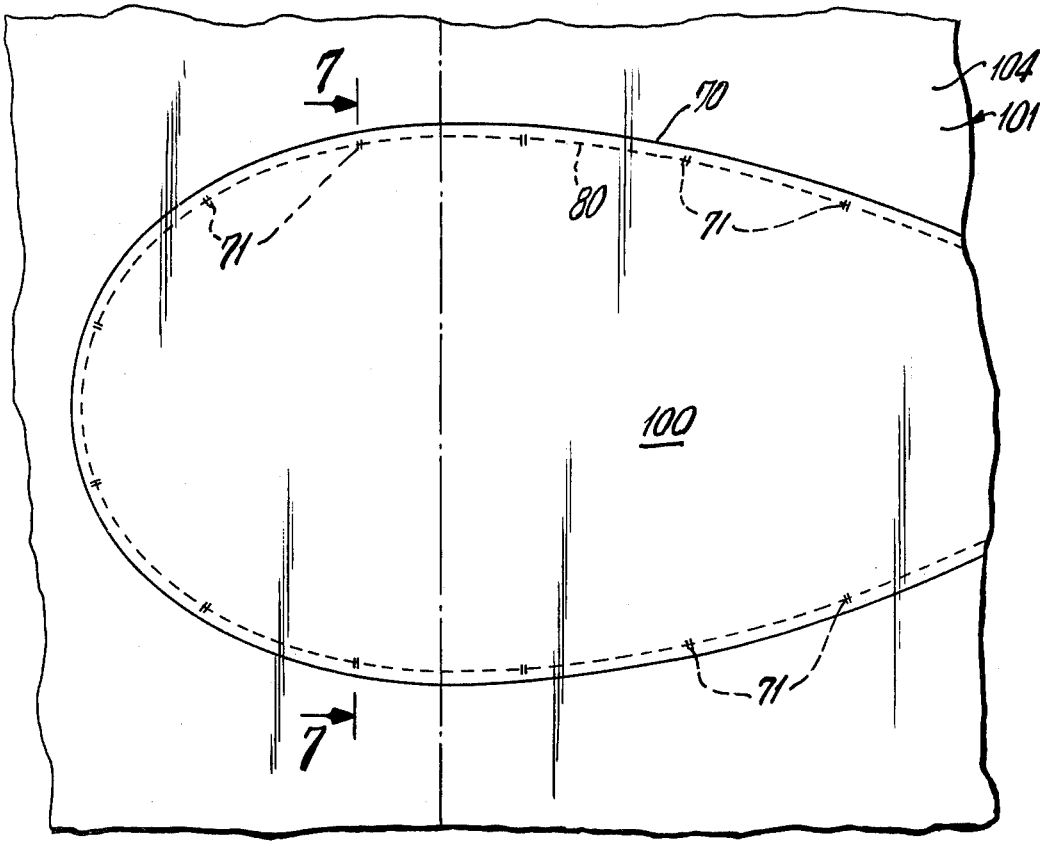
FIG. 6 is a plan view of a third embodiment of a tear open member of a carton according to the subject invention.
Figure 7:
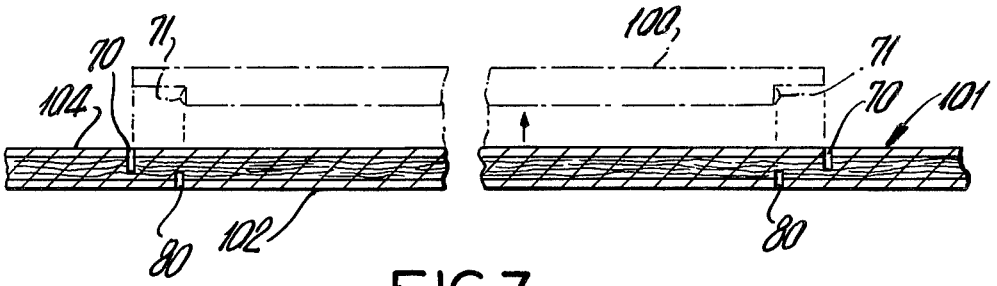
FIG. 7 is a cross-sectional view taken along line 7—7 in FIG. 6.

Turning to FIGS. 6 and 7, in an alternate embodiment, the generally oval tear out member 100 is defined by generally parallel, oval cuts 70 and 80. Cut 80 is disposed in the under surface 102 of the paperboard substrate and penetrates the substrate to a point intermediate the thickness thereof. Cut 70 in the upper surface 104 the paperboard substrate is disposed parallel to and outwardly of cut 80. Preferably, cut 70 penetrate the substrate to a point intermediate the thickness thereof. If desired, reinforcement hinges 71 may be provided in the carton along the peripheral edge of the tear out member 100. As the latter is removed from the carton 101, tensile and shearing forces are exerted between the upper cut 70 and the lower cut 80 such that access member 100 tears along the upper cut 70 and shears the substrate intermediate it thickness in the substrate core area between cuts 70, 80. As a result access member 100 is removed from the carton 101 in the manner illustrated in the phantom portion of FIG. 7. Preferably the paperboard substrate would be a solid bleached sheet whereby the line of shear between cuts 70 and 80 would appear white after removal of the access panel or tear out member 100.

While the preferred embodiment of the subject invention has been described and illustrated, it would be obvious that various changes and modifications can be made therein without departing from the spirit of the invention which should be limited only by the scope of the appended claims.

What is claimed is:

1. A paperboard carton made of a paperboard substrate including an outer, upper layer having a protective polyethylene coating, an inner, lower layer of uncoated paperboard stock, and an intermediate core layer including plies of thin, newsback board, said carton having a tear-out access member defined by a first cut portion generally oval in configuration disposed on said upper substrate surface and penetrating said upper layer to a point intermediate the thickness of the core layer, a second cut portion generally oval in configuration disposed on said under substrate surface, said second cut portion being spaced apart from the first cut portion and substantially enveloping said first cut portion, said second cut portion penetrating said lower layer to a point intermediate the thickness of the core layer; and spaced apart reinforcing means disposed on said substrate undersurface within said second cut at a predetermined angle to said second cut.

2. A tear out access member as recited in claim 1 in which said spaced apart reinforcement means are disposed at an angle of 90° to said second cut portion.

3. A tear out access member as recited in claim 1 in which each said spaced apart reinforcement means is disposed at an angle of 45° to said second cut portion.

4. A tear out access member as recited in claim 1 in which said first cut portion is spaced from said second cut portion approximately 1/32 inches.

5. A tear out access member as recited in claim 1 in which said first cut portion is spaced from said second cut portion approximately 1/16 inches.

6. A tear out access member as recited in claim 1 in which said reinforcement means have a thickness approximately equal to that of the paperboard substrate.

7. A tear out access member as recited in claim 1 which further includes second spaced apart reinforcement means disposed on said upper substrate surface and within said first cut portion at a predetermined angle to said first cut portion.

8. A tear out access member as recited in claim 7 in which the second spaced apart reinforcement means are disposed at an angle of 90° to said first cut portion.

9. A tear out access member as recited in claim 7 in which each said second spaced apart reinforcement means is disposed at an angle of 45° to said first cut portion.

* * * * *